US006167674B1

(12) United States Patent
Nanayakkara

(10) Patent No.: US 6,167,674 B1
(45) Date of Patent: Jan. 2, 2001

(54) LIGHT-GAUGE TRUSS FRAMING ELEMENT

(76) Inventor: Lakdas Nanayakkara, 2211 NE. 54th St., Fort Lauderdale, FL (US) 33308

( * ) Notice: Under 35 U.S.C. 154(b), the term of this patent shall be extended for 0 days.

(21) Appl. No.: 09/087,952

(22) Filed: Jun. 1, 1998

(51) Int. Cl.[7] ..... E04C 3/04

(52) U.S. Cl. ..... 52/731.7; 52/729.5; 52/730.6; 52/731.1; 52/737.3; 52/634; 52/650.1; 52/690

(58) Field of Search ..... 52/729.5, 730.6, 52/731.1, 731.7, 737.1, 737.3, 634, 647, 650.1, 690, 693, 696, 506.07, 737.6, 739.1; D25/61, 126, 127

(56) References Cited

U.S. PATENT DOCUMENTS

| | | | | |
|---|---|---|---|---|
| Re. 31,528 | * | 3/1984 | Mieyal | 52/506.07 X |
| D. 157,994 | * | 4/1950 | Palmer | 52/737.1 X |
| 1,837,748 | * | 12/1931 | Baum | 52/730.6 X |
| 2,286,976 | * | 6/1942 | Roberts . | |
| 2,387,432 | * | 10/1945 | Du Laney . | |
| 2,866,233 | * | 12/1958 | Lydard . | |
| 3,137,922 | * | 6/1964 | Schumacher . | |
| 3,222,040 | * | 12/1965 | Eckert | 52/737.6 X |
| 3,327,444 | * | 6/1967 | Downing et al. | 52/731.7 X |
| 4,720,956 | * | 1/1988 | Wiklund | 52/737.6 X |
| 4,986,051 | * | 1/1991 | Meyer et al. | 52/731.7 X |
| 5,241,798 | * | 9/1993 | Platt et al. | 52/506.07 X |
| 5,553,437 | * | 9/1996 | Navon | 52/731.1 X |
| 5,896,724 | * | 4/1999 | Tofts | 52/506.07 X |

* cited by examiner

*Primary Examiner*—Robert Canfield
(74) *Attorney, Agent, or Firm*—M. K. Silverman

(57) ABSTRACT

A light-gauge truss framing element constitutes a longitudinal constructional beam having a uniform generally T-shaped cross-section, in which a vertical portion of the cross-section defines a web of the beam and a transverse horizontal portion defines a symmetric flange. The beam comprises a material having a thickness in a range of about ten to about twenty-two gauge and having a yield strength in a range of about thirty-six to about fifty-five kips per square inch. The web, in transverse cross-section, resembles a compressed V-shaped element which may be selectably reinforced through the use of rods or stiffening elements internal or external to the apex of the V-shaped web.

5 Claims, 15 Drawing Sheets

LIGHT-GAUGE TRUSS FRAMING ELEMENT

BACKGROUND OF THE INVENTION

The present invention relates to a framing element particularly adapted for use in light load applications such as residential and commercial structures.

In the recent years, there has been a development in the technology of press-joint connection of metal parts by cold forming. In such technology, a punch of, for example, a type sold by Eckold AG pushes respective surfaces of light gauge steel (or other metal) against each other and then, using high impact hydraulic or pneumatic means, creates a cold-formed joint, that is, a securement between such surfaces of the light gauge steel members.

Tools for effecting such press-joining of light gauge steel in order to accomplish framing and other applications may be accomplished through the use of mobil hand-held or hand-guided tools usable during in-house and on-site construction. The present invention is therefore directed to a truss framing. element particularly adapted to take advantage of such contemporary techniques of the press-joining light gauge steel elements to each other.

SUMMARY OF THE INVENTION

The instant invention relates to a light-gauge truss framing element which comprises a longitudinal constructional chord or beam having a uniform generally T-shaped cross-section, in which a vertical portion of said cross-section defines a web of the beam and a transverse horizontal portion thereof defines a symmetric flange. Therein, the beam comprises a material having a thickness in a range of about ten to about twenty-two gauge and having a yield strength in a range of about thirty-six to about fifty-five kips per square inch. The web, in transverse cross-section, resembles a compressed V-shaped element which may be selectably reinforced through the use of rods or stiffening elements internal or external to the apex of the V-shaped web.

It is an object of the invention to provide a longitudinal constructional beam having particular application in light gauge steel framing, utilizing press-joining technology.

It is another object to provide a light gauge truss framing element.

It is a further object of the invention to provide a light gauge constructional beam including a reinforced web portion thereof.

The above and yet other objects and advantages of the present invention will become apparent from the hereinafter set forth Brief Description of the Drawings, Detailed Description of the Invention, and claims appended herewith.

DETAILED DESCRIPTION OF THE INVENTON

Figure 1:
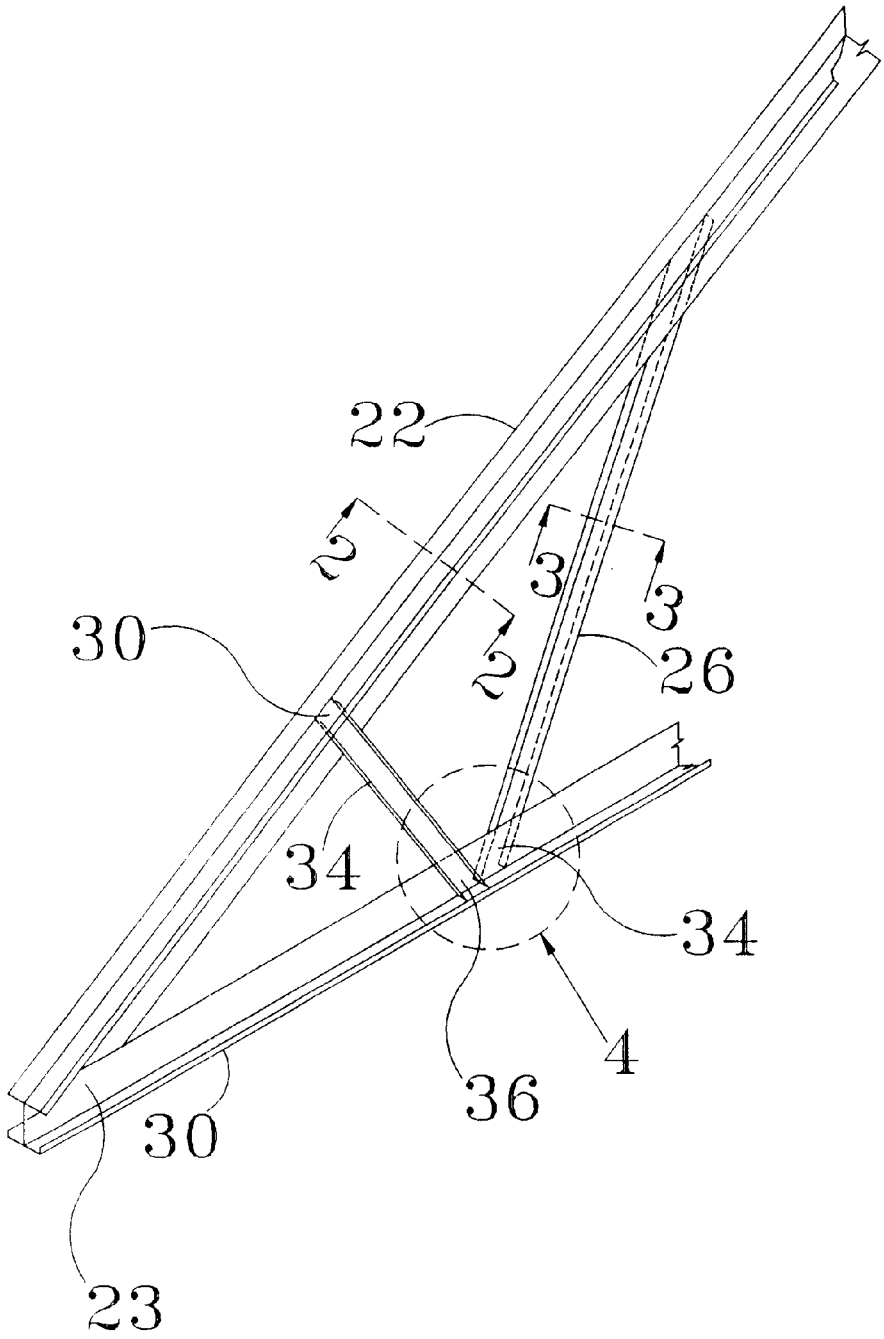
FIG. 1 is a schematic perspective view of a portion of a truss of a type that may be formed with framing elements of the present invention.

Shown in FIG. 1 is a portion of the light-gauge truss assembled using the press-joining technique set forth above. There is, more particularly, shown a base framing element 30 and a diagonal framing element or beam 22. Said elements 30 and 22 constitute the subject matter of the instant invention. Between said elements 30 and 22 are U-shaped connecting elements or beams 34 and 26. All of the points of connection between said framing elements, that is, points 28, 30, 32, 34 and 36 are all effected through the above-referenced press-joining technique for light gauge steel (often referred to as clinching).

With reference to the transverse cross-sectional view taken along Line 2—2 of FIG. 1, the instant inventive truss framing element 22 may be seen to define a uniform generally T-shaped cross-section in which a vertical portion thereof defines a web 38 and in which a transverse horizontal portion thereof defines a symmetric flange 40 of the beam 22. Said flange 40 includes transversely dependent lips 42 which are substantially co-parallel with said web 38. Further, as may be noted in FIG. 2, the web 38 comprises a transversely compressed V-shaped element.

Figure 3:
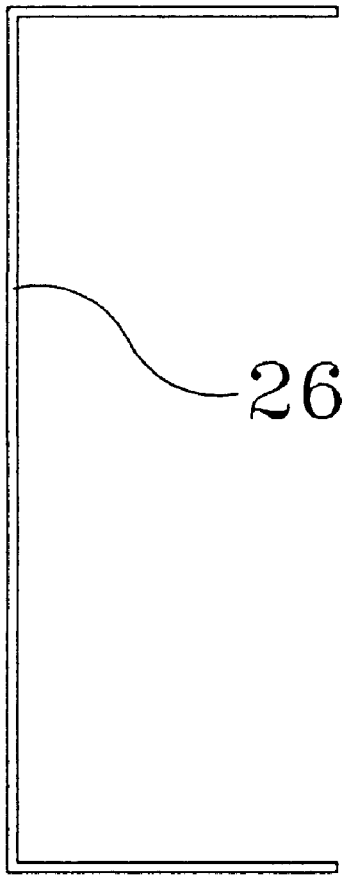
FIG. 3 is a cross-sectional view of the internal support elements of the truss, taken along Line 3—3 of FIG. 1.

Shown in FIG. 3 is a cross-sectional view of the framing element 26. As may be noted, this element is substantially U-shaped and reflects the prior art of such .

Figure 4:
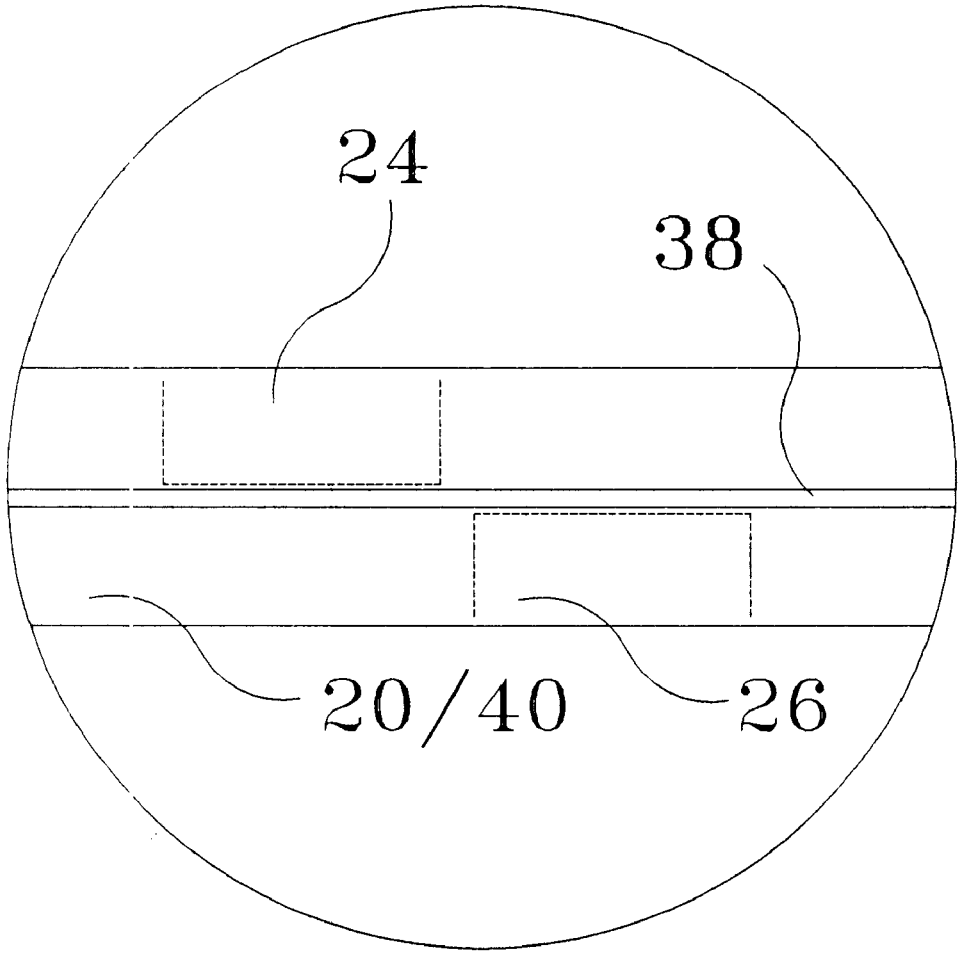
FIG. 4 is an enlarged view of the dotted area of FIG. 1 showing press-joint connections between ends of an internal support element and the web of the lower peripheral framing element shown in FIG. 1.

FIG. 4 is an enlarged view taken of region 4 of FIG. 1 showing the bottom or footprint of said V-shaped beams 24 and 26 relative to flange 40 of the T-shaped beam 20 shown in FIG. 1.

Figure 2:
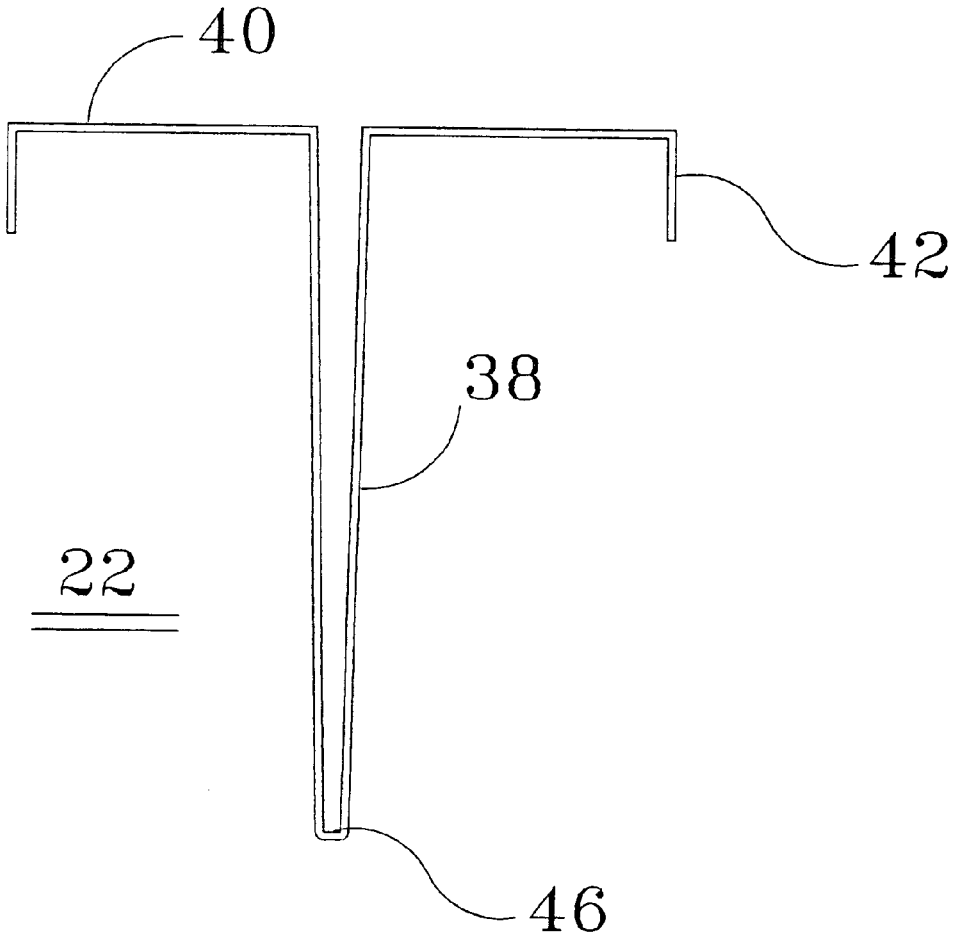
FIG. 2 is a transverse cross-sectional view of a peripheral framing element of the truss taken along Line 2—2 of FIG. 1.
Figure 5:
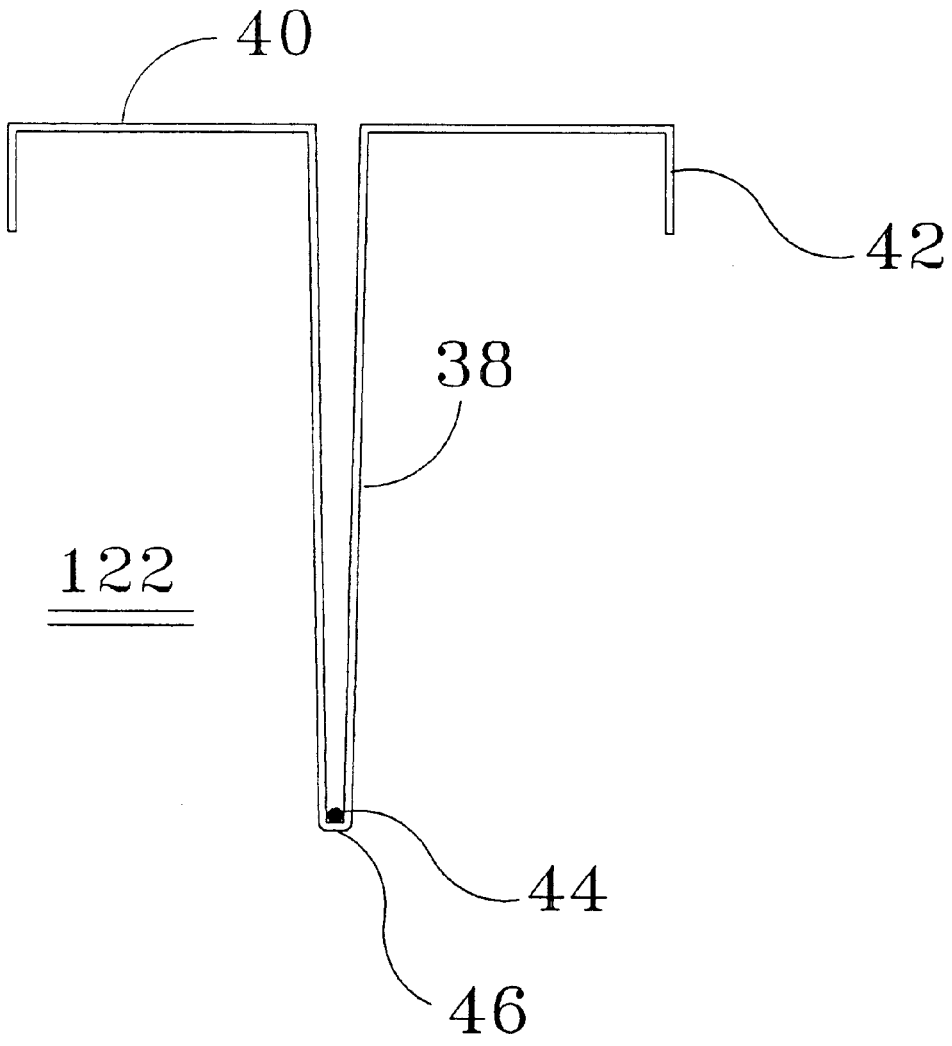
FIG. 5 is a cross-sectional schematic view, corresponding to that of FIG. 2, however showing the use of a longitudinal bar situated at the bottom of the apex of the web to stiffen the framing element and to appropriately alter the location of the neutral axis of the beam.

Shown in FIG. 5 is a second embodiment 122 of the constructional beam shown in FIG. 2 in which there is provided a longitudinal stiffening rod 44 along all or part of the longitudinal length of the interior of apex 46 of the web 38. Such rod 44 operates to move the so-called neutral axis of the beam downward away from flange 40 in the direction of web apex 46. By so moving the neutral axis, the second moment of inertia of the beam is moved in a direction which increases its stability within a mechanical system, when exposed to loads and vibration. Thereby shear is removed at the neutral axis thereby balancing bending stresses above and below the neutral axis.

Figure 6:
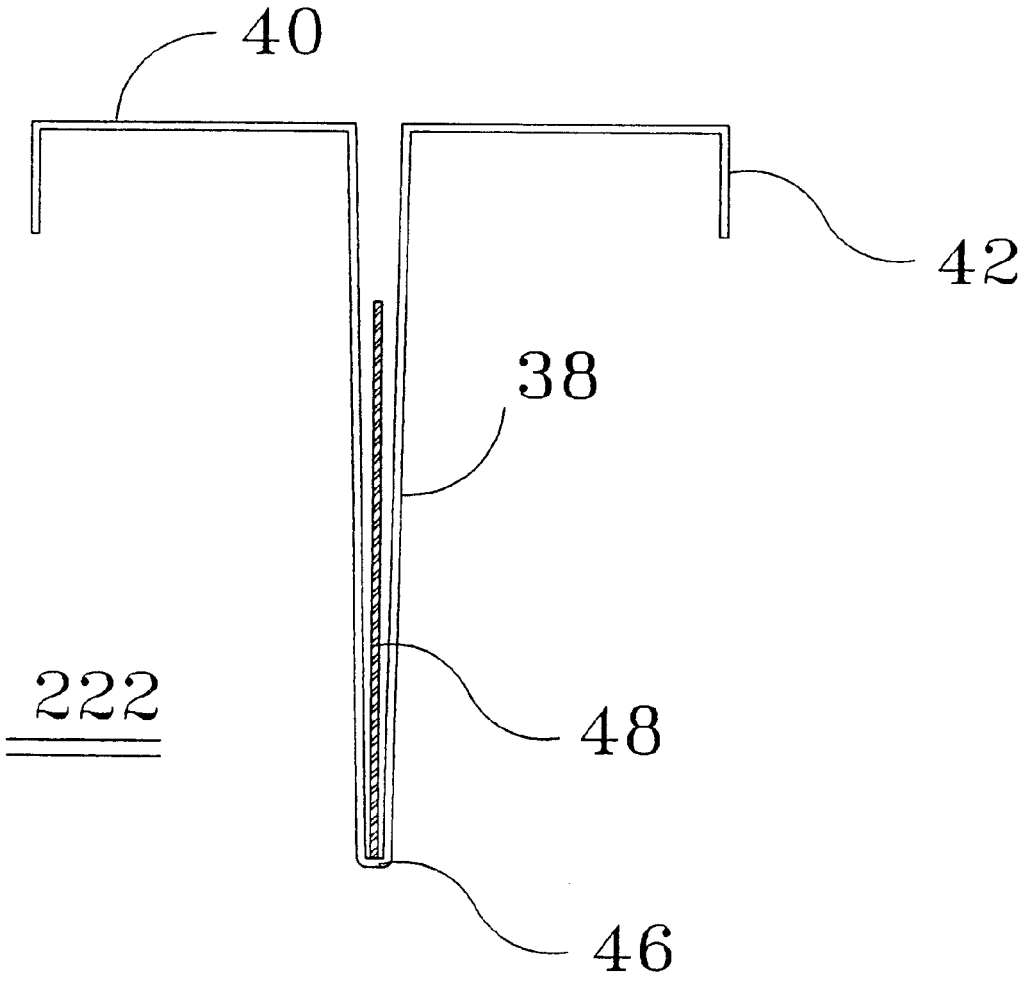
FIG. 6 is a transverse cross-sectional view of another embodiment of the invention showing the use of a longitudinal stiffening element within the web.

Shown in FIG. 6 is a third embodiment 222 of the invention in which a longitudinal stiffening plate 48 is provided within the V-shaped portion of web 38. Through the use of this embodiment, the neutral axis of the beam can be controlled as a function of the vertical dimension thereof. Further, the strength of the web 38 is enhanced thereby increasing the applications of framing elements in accordance with the present invention.

Figure 7:
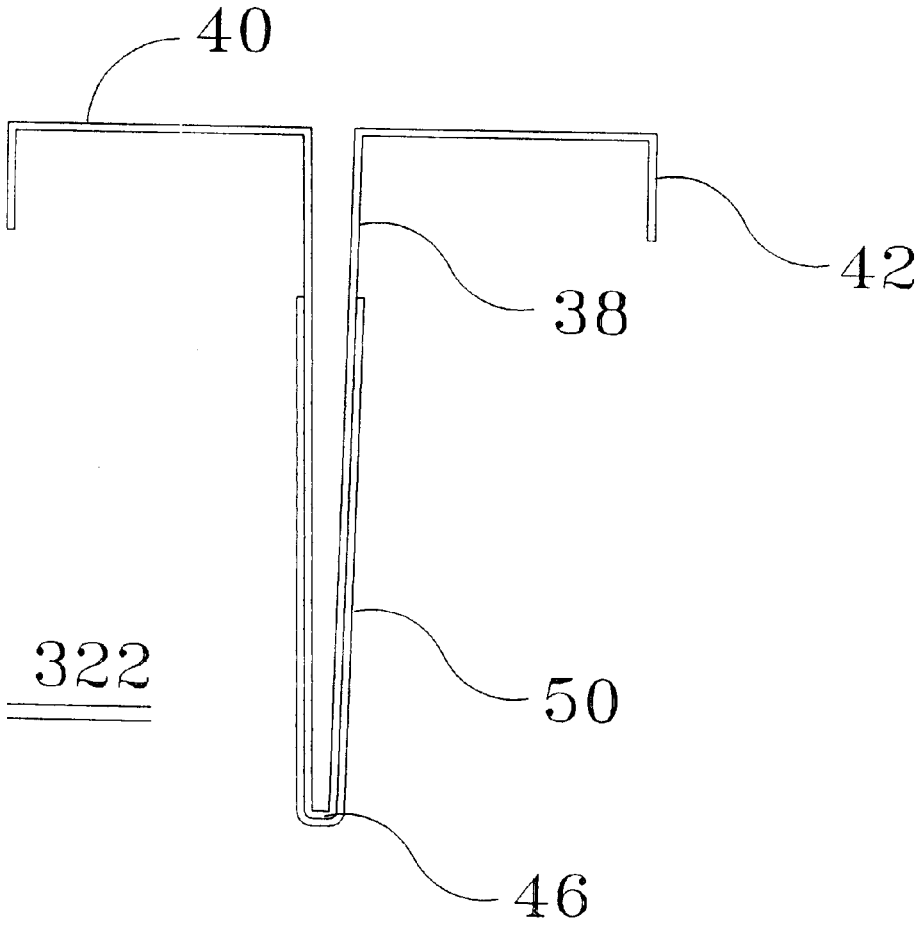
FIG. 7 is a transverse cross-sectional view of a further embodiment of the invention showing use of an external element having a substantially triangular cross-section for stiffening the web of the framing element.

Shown in FIG. 7 is a further embodiment, that is, constructional beam 322 in which the stiffening element 50 is provided externally to the V-shaped portion of web 38 and conformally thereabout. This embodiment is of value not only in its modification of the neutral axis but, as well, is important when a change in surface characteristic of can 38 will assist in achieving an engineering objective, such as, improving securement to an abutting surface or reducing potential vibration between such surfaces.

Figure 8:
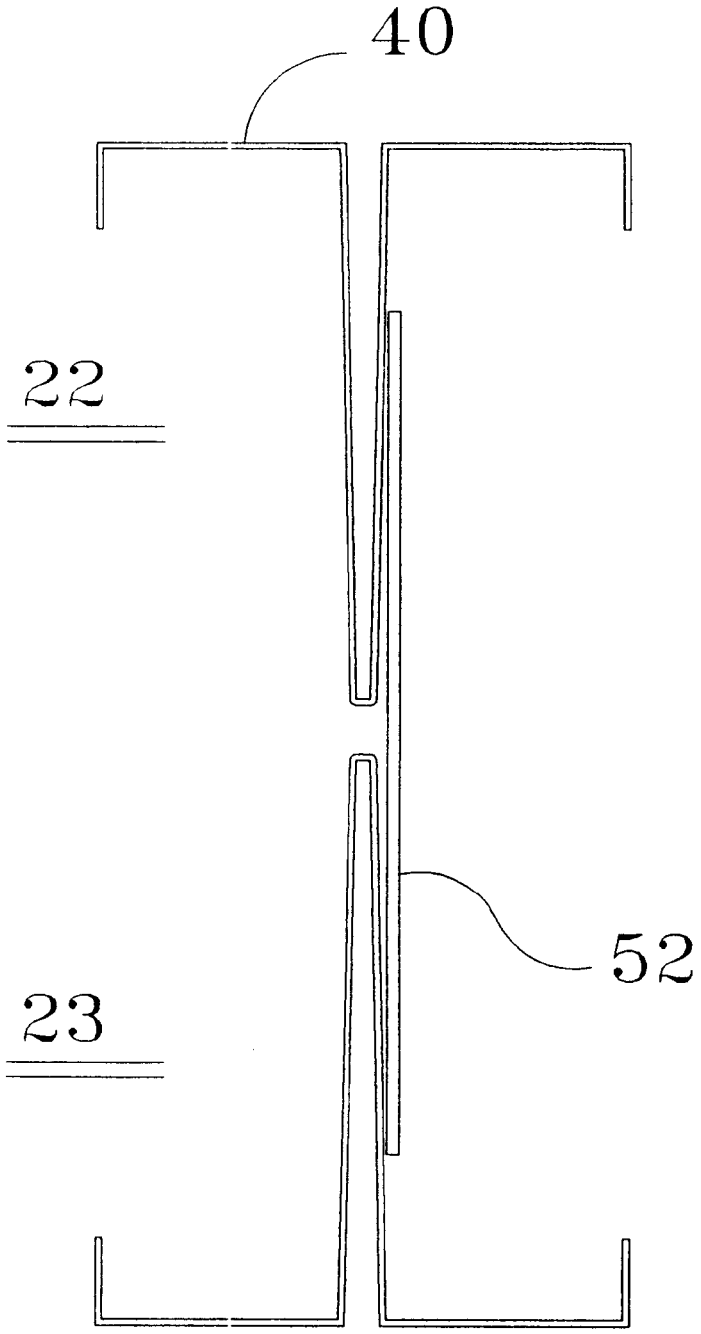
FIGS. 8, 9 and 10 are cross-sectional views showing the manner in which a connecting plate can be used to mutually secure neutral webs of different embodiments the invention.

Shown in FIG. 8 is an apex-to-apex press-joint securement of constructional beams 22 and 23 to each other utilizing a light gauge steel securing plate 52.

Figure 9:
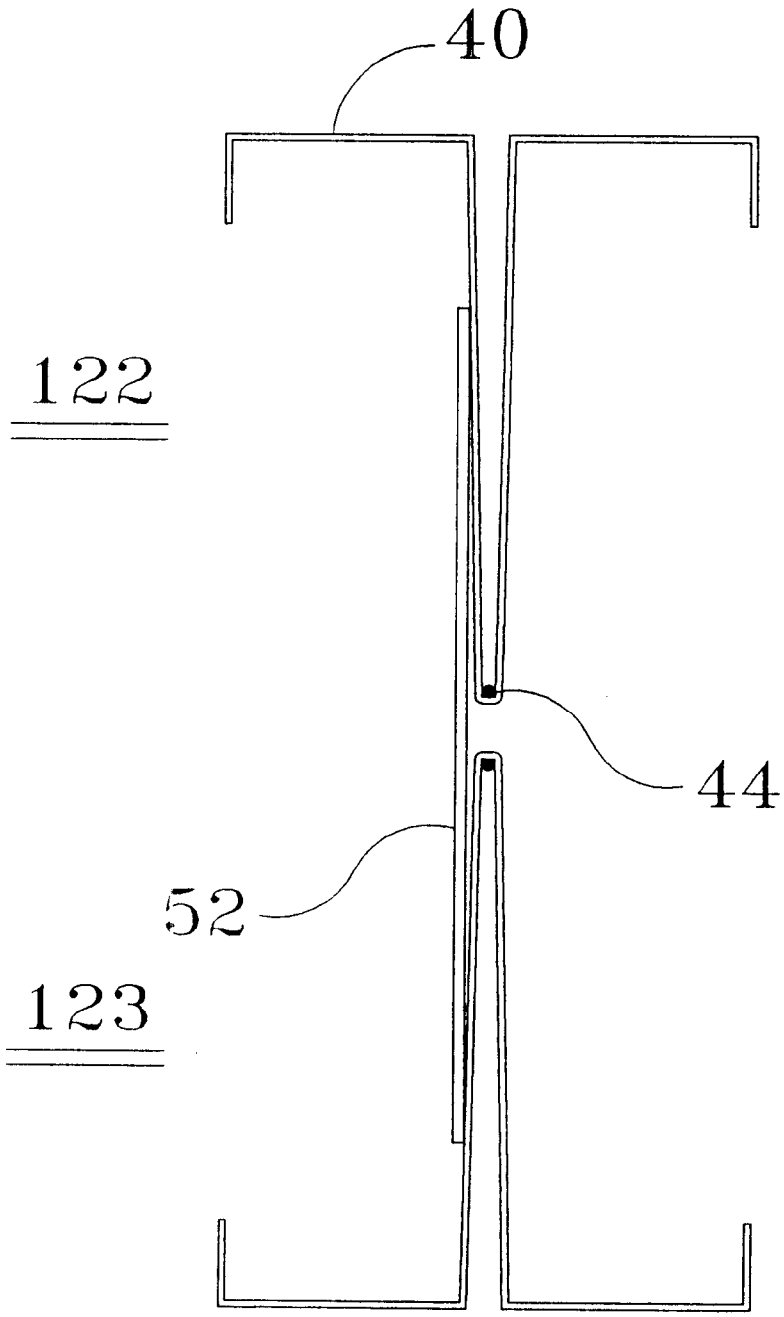
Figure 10:
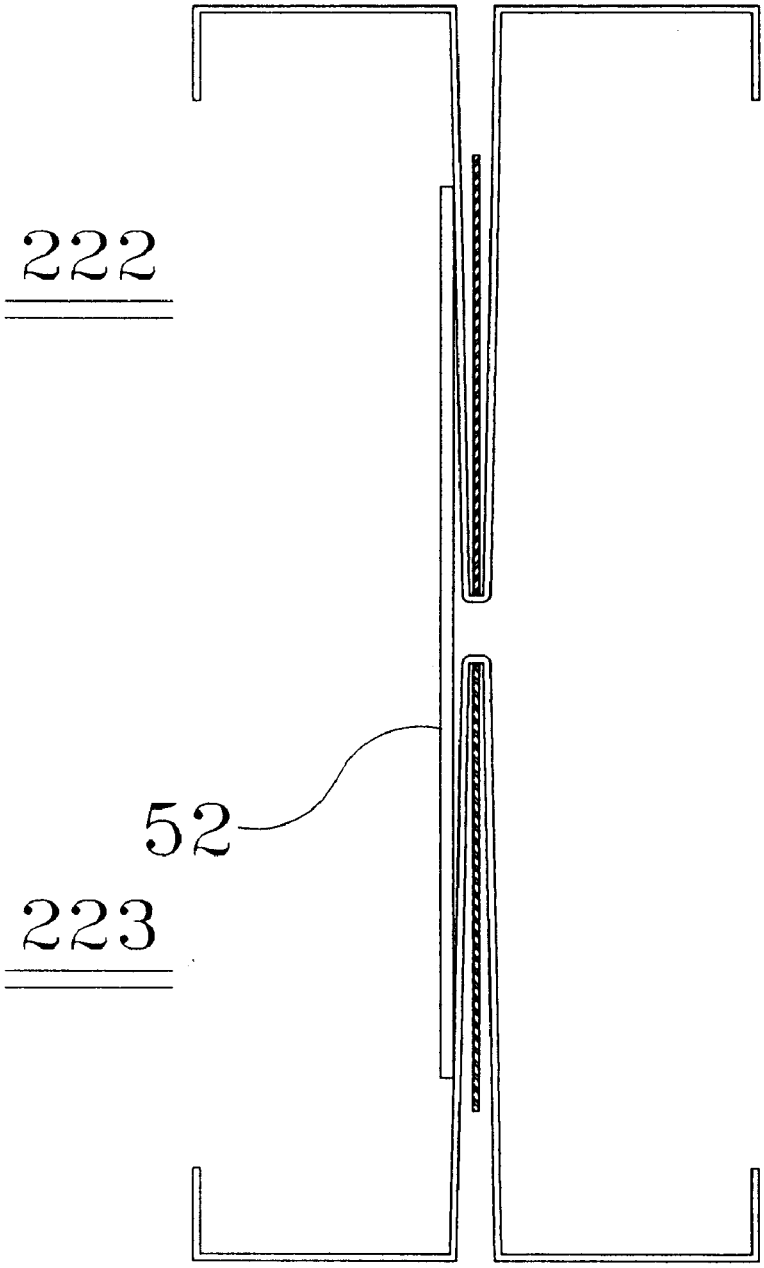

FIGS. 9 and 10 are comparable views showing apex-to-apex connections with reference to the embodiments of FIGS. 5 and 6 respectively.

It is noted that all constructional beams in accordance with the present invention are preferably formed of a steel material having a thickness of about ten to about twenty-two gauge and having a yield strength in a range of about thirty-six to about fifty-five kips per square inch.

Figure 11:
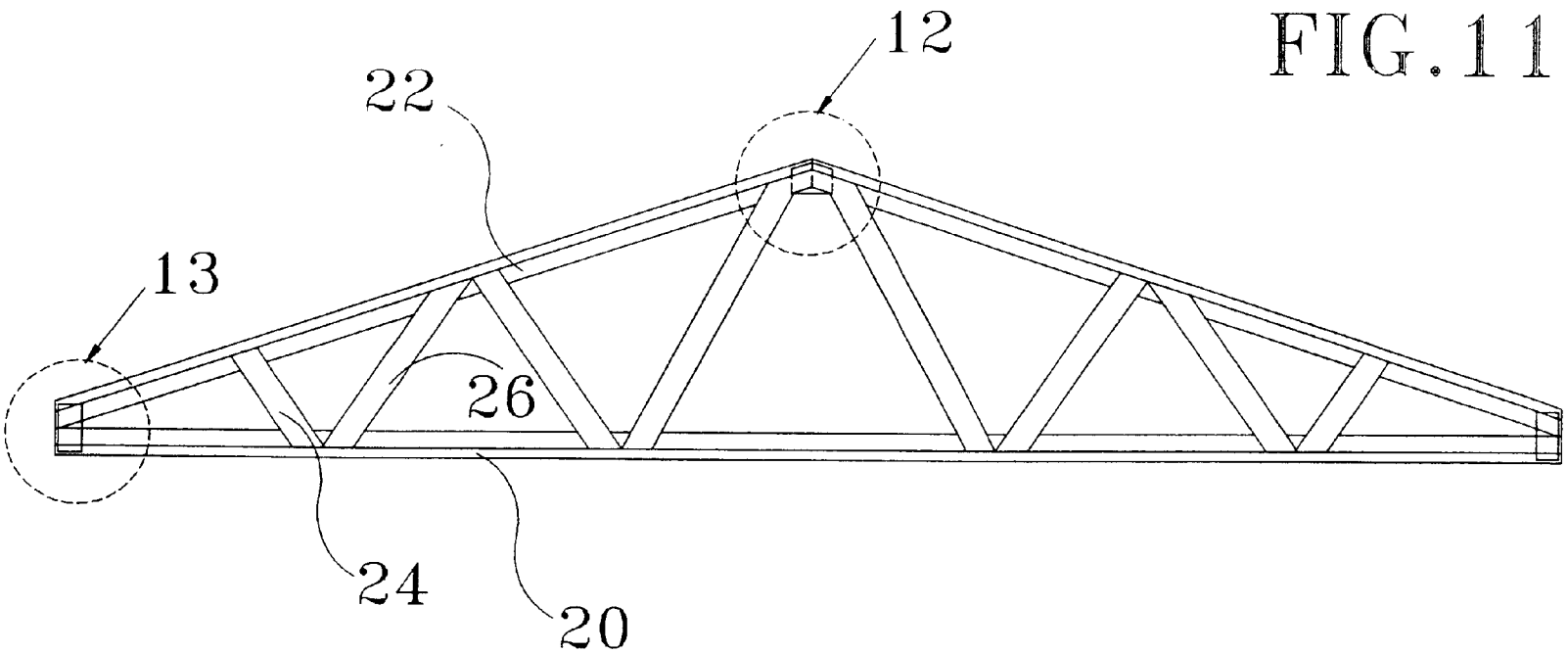
FIG. 11 is a front plan view of a truss of a type that may be formed with framing elements of the invention.
Figure 12:
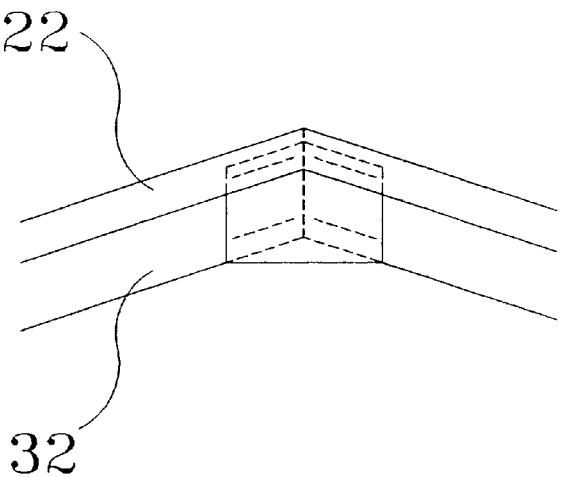
FIG. 12 is an enlarged view showing the manner of the securement of reinforcing plates to the apex of a truss utilizing press-joining technology.
Figure 13:
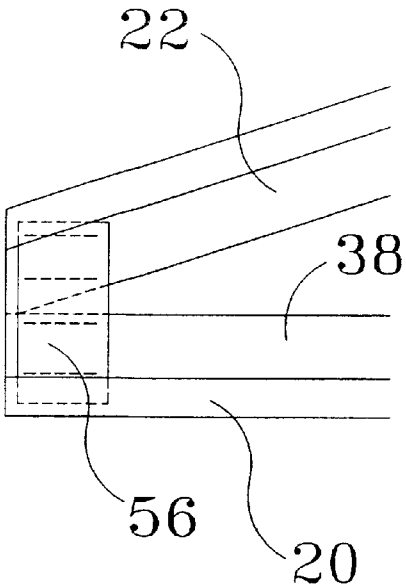
FIG. 13 is a view of reinforcing plates secured against the intersection of a base member and diagonal members of a truss.

Shown in FIG. 11 is a truss of a type which may be readily formed in accordance with the present invention. There is shown in FIG. 11, a complete view of the truss shown in fragment in FIG. 1. However, the encircled areas of FIG. 11 are shown as enlarged views in FIGS. 12 and 13. Therein are shown securing plates 54 and 56 respectively which attach to the webs 38 of the respective beams 20 and 22. It is noted that flanges 40 of the various embodiments of the invention are generally employed for the securement of wood or other sheet-like material thereto. Such securement usually is effected through the use of a power stapling device. It is, as such, to be appreciated that the present inventive light gauge framing elements 22, 122, 222, and 322 are all usable as a part of the system in which an entire truss and roof assembly, including the roof itself, may be installed without the use of any power lifting machinery whatsoever.

Figure 14:
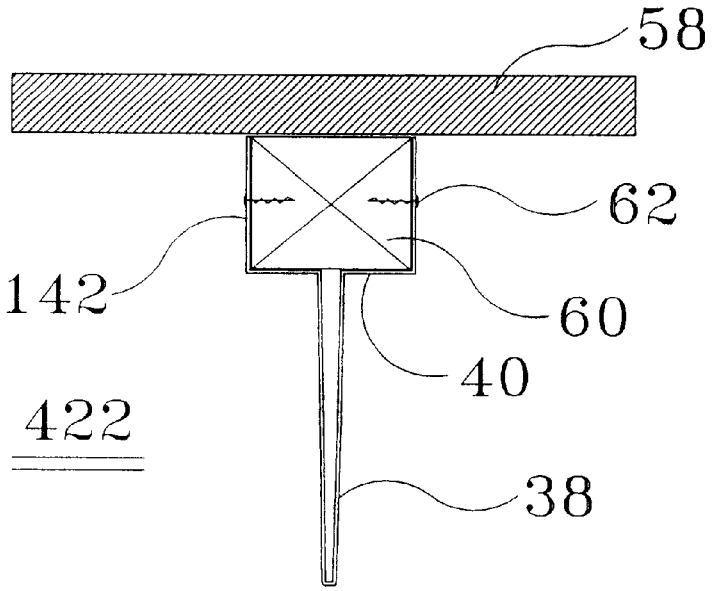
FIG. 14 is a transverse cross-sectional view of a futher embodiment of the invention in which wood-like longitudinal members may be secured within flanges of the present framing element.

In FIG. 14 is shown a further embodiment 422 of the invention in which lips 142, rather than depending in the direction of apex 40, depend upwardly, away from flange 40 and in the direction of a roofing element 58. Therein, a longitudinal wood-like member 60 is secured between lips 142 and flange 40 and secured therein through the use of fastening means 62. In such embodiment the sheet-like roofing element 58 may be readily secured thereto.

Figure 15:
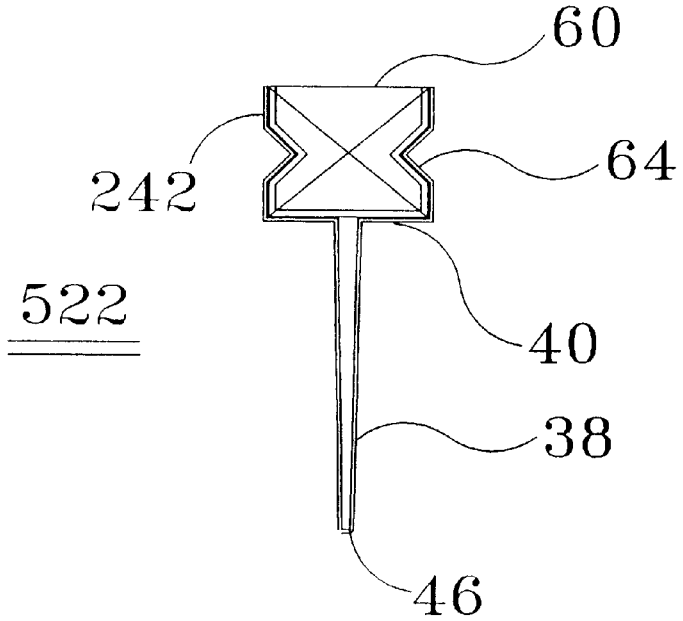
FIG. 15 shows a variation of the embodiment of FIG. 14 in which said wood-like members may be snap-fit between lips of flanges of the framing element.

Shown in FIG. 15 is a variant 522 of the embodiment of FIG. 14 in which press-fit means 64 are used in lieu of said fastening means 62 to secure longitudinal wood-like member 60 between upwardly directed lips 242 and the flange 40.

Figure 16A:
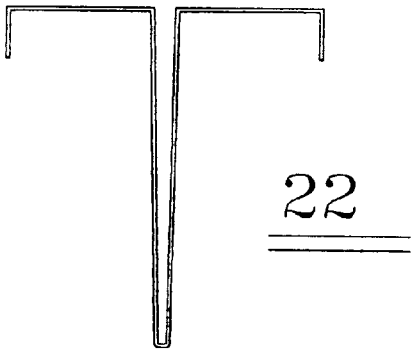
FIGS. 16A to 16E are schematic cross-sectional views of the embodiments of the invention.
Figure 16B:
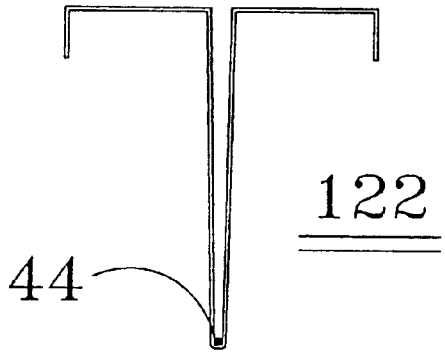
Figure 16D:
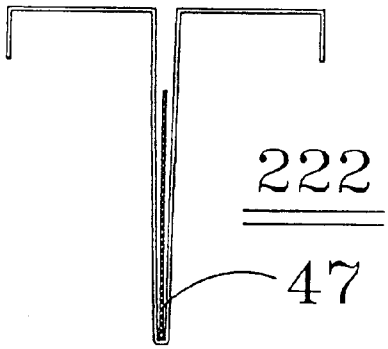
Figure 16C:
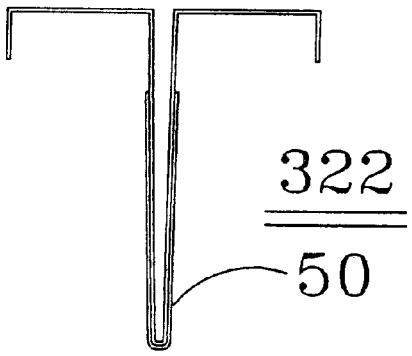
Figure 16E:
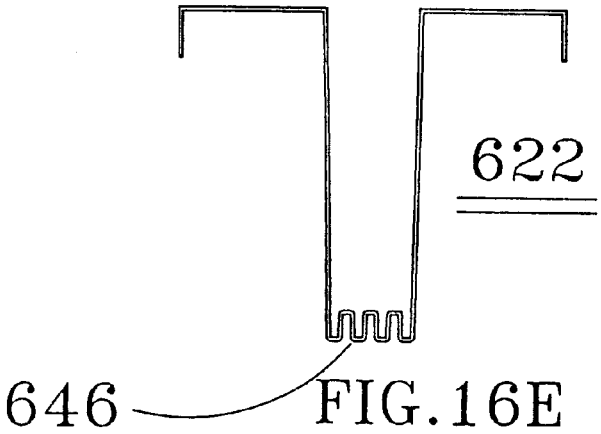
Figure 17A:
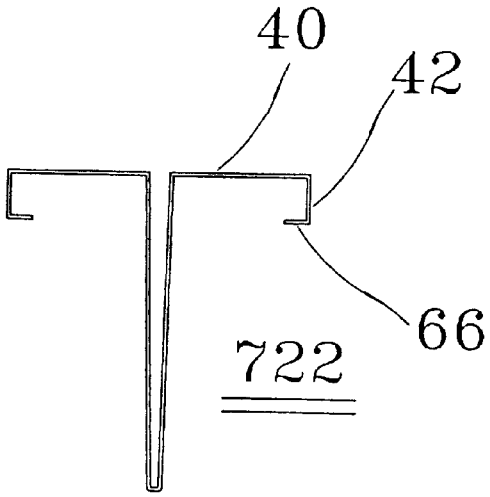
FIGS. 17A to 17E are views, similar to those of FIG. 16A to 16E, showing a variant of the lip of the flange of the framing element.
Figure 17B:
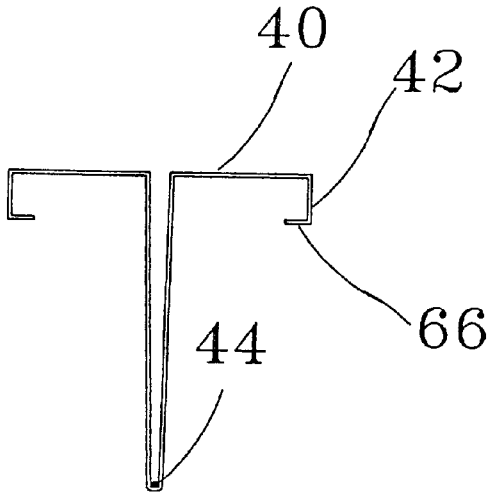
Figure 17D:
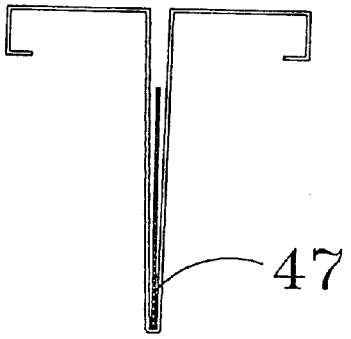
Figure 17C:
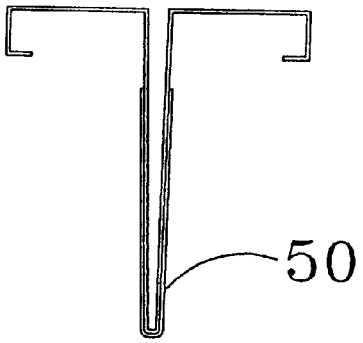
Figure 17E:
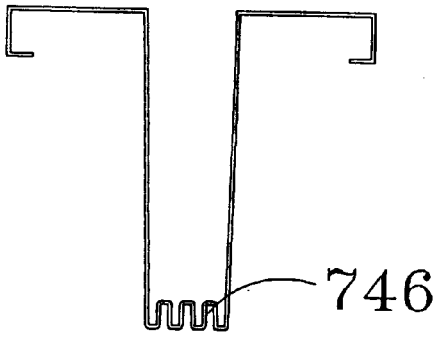

FIGS. 16A to 16D comprise a review of the above-described embodiments 22, 122, 222 and 322. However, FIG. 16E shows a further embodiment, that is, framing element 722 in which there is provided a corrugated apex 746 of the truss element.

In FIG. 17A to 17E are shown all of the embodiments of FIG. 16A to 16E in which each lip 42 of each flange 40 is provided with inwardly directed edges 66. This feature enhances the structural integrity of all embodiments of the framing element.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention, what I claim as new, useful and non-obvious and, accordingly, secure by letters patent of the united states is:

1. A light gauge truss framing element, comprising:

a longitudinal construction beam having a uniform generally T-shaped cross section in which a substantial vertical portion of said cross section defines a web of said beam, said web comprising a transversely compressed U-shaped element, having a longitudinal vertical plane of symmetry, said web having a transverse horizontal portion defining a symmetric flange of said beam, in which outer edges of said flange include transversely dependent lips substantially co-parallel with said web and directed generally toward said plane of symmetry of said U-shaped element, said element further comprising longitudinal stiffening means disposed along at least a segment of length of said u-shaped element and further in which said beam comprises a material having a thickness in a range of about 10 to about 22 gauges and having a yield strength in a range of about 36 to about 55 kips per square inch.

2. The framing element as recited in claim 1 in which said stiffening mean of said U-shaped element comprises a longitudinal rod disposed along a length thereof, thereby defining an axis co-parallel with a longitudinal axis defined by said beam.

3. The framing element as recited in claim 1, in which said stiffening means of said U-shaped element comprises a longitudinal stiffening plate, disposed along a length of said plane of symmetry of said U-shaped element, thereby defining a plane substantially normal to a plane defined by said flanges of said beam.

4. The framing element as recited in claim 1, in which symmetric opposing surfaces at or about an intersection of said U-shaped element and at said plane of symmetry thereof include, along a length thereof, a U-shaped stiffening plate complemtental in geometry to said compressed U-shaped element of said web of said beam.

5. The framing element as recited in claim 1 in which said dependent lips of said flange are proportioned for snap-fit insertion of wood-like longitudinal members within said dependent lips.

* * * * *